US011840672B2

(12) United States Patent
Pradeep et al.

(10) Patent No.: US 11,840,672 B2
(45) Date of Patent: Dec. 12, 2023

(54) INTEGRATED PROCESS FOR CONVERTING CRUDE OIL TO HIGH VALUE PETROCHEMICALS

(71) Applicant: Indian Oil Corporation Limited, Mumbai (IN)

(72) Inventors: Ponoly Ramachandran Pradeep, Faridabad (IN); Shahil Siddiqui, Faridabad (IN); Vineeth Venu Nath, Faridabad (IN); Darshankumar Manubhai Dave, Faridabad (IN); Mainak Sarkar, Faridabad (IN); Satyen Kumar Das, Faridabad (IN); Madhusudan Sau, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 18/152,941

(22) Filed: Jan. 11, 2023

(65) Prior Publication Data

US 2023/0227738 A1 Jul. 20, 2023

(30) Foreign Application Priority Data

Jan. 20, 2022 (IN) ..... 202221003413

(51) Int. Cl.

| | |
|---|---|
| ***C10G 67/16*** | (2006.01) |
| ***C10G 67/02*** | (2006.01) |
| ***C10G 69/14*** | (2006.01) |

(52) U.S. Cl.

CPC ..... *C10G 67/16* (2013.01); *C10G 67/02* (2013.01); *C10G 69/14* (2013.01); *C10G 2300/1033* (2013.01); *C10G 2300/301* (2013.01); *C10G 2300/4006* (2013.01); *C10G 2300/4012* (2013.01); *C10G 2300/4025* (2013.01); *C10G 2300/4081* (2013.01); *C10G 2400/20* (2013.01); *C10G 2400/30* (2013.01)

(58) Field of Classification Search

CPC ..... C10G 67/16; C10G 67/02; C10G 69/14; C10G 2300/1033; C10G 2300/301; C10G 2300/4006; C10G 2300/4012; C10G 2300/4025; C10G 2300/4081; C10G 2400/20; C10G 2400/30

See application file for complete search history.

(56) References Cited

U.S. PATENT DOCUMENTS

| | | | |
|---|---|---|---|
| 7,550,642 | B2 | 6/2009 | Powers |
| 8,658,022 | B2 | 2/2014 | Bridges et al. |

(Continued)

FOREIGN PATENT DOCUMENTS

| | | | |
|---|---|---|---|
| WO | 2013/112967 | A1 | 8/2013 |
| WO | 2014/062465 | A1 | 4/2014 |

*Primary Examiner* — Prem C Singh
*Assistant Examiner* — Juan C Valencia
(74) *Attorney, Agent, or Firm* — Workman Nydegger

(57) ABSTRACT

The present invention relates to a process and system for complete conversion of crude oils by integrating Desalter unit, Atmospheric and vacuum column, high severity FCC process, Naphtha cracking process, residue slurry hydrocracking process, Delayed coking process, Selective mild hydrocracking aromatic production unit, Dehydrogenation units, Aromatic/olefin recovery section, gasifier unit along with syngas to olefins conversion section.

18 Claims, 4 Drawing Sheets

(56) References Cited

U.S. PATENT DOCUMENTS

| | | | | |
|---|---|---|---|---|
| 9,290,705 | B2 | 3/2016 | Bourane et al. | |
| 9,550,707 | B2 | 1/2017 | Schrod et al. | |
| 10,259,758 | B2 * | 4/2019 | Ward | C10G 69/04 |
| 2013/0197284 | A1 | 8/2013 | Bourane et al. | |
| 2013/0292299 | A1 | 11/2013 | Koseoglu et al. | |
| 2015/0321975 | A1 | 11/2015 | Choi et al. | |
| 2016/0122668 | A1 | 5/2016 | Sayed et al. | |
| 2019/0256786 | A1 | 8/2019 | Pradeep et al. | |

* cited by examiner

INTEGRATED PROCESS FOR CONVERTING CRUDE OIL TO HIGH VALUE PETROCHEMICALS

FIELD OF THE INVENTION

The present invention relates to a process of converting crude oil to produce petrochemical feedstocks such as light olefins and aromatics. More particularly, the present invention relates to a processing scheme involving integrating Desalter unit, Atmospheric and vacuum column, high severity FCC process, Naphtha cracking process, residue slurry hydrocracking process, Delayed coking process, Selective mild hydrocracking aromatic production unit, Dehydrogenation units, Aromatic/olefin recovery section, gasifier unit along with syngas to olefins conversion section.

BACKGROUND OF THE INVENTION

U.S. Pat. Nos. 7,550,642B2 and 8,658,022B2 describes olefin production process utilizing whole crude oil/condensate as feedstock using thermal cracking process. Here the feed is sent to a vaporization step other than distillation, thereby producing a vaporous output and a liquid bottoms fraction and the vaporous output is fed to cracking furnace in presence of steam. In the later patent, liquid bottom fraction is sent to a hydro processing unit for further conversion.

U.S. Pat. No. 9,290,705B2 describes a process in which crude oil feedstock having total metals (Ni+V)<5 ppm and CCR <5 wt % is fractionated into a low boiling fraction & a high boiling fraction. The low boiling fraction is catalytically cracked in a first downflow reaction zone & high boiling fraction is catalytically cracked in a second downflow reaction zone of fluid catalytic cracking unit, having a common catalyst regeneration system.

U.S. Pat. No. 9,550,707B2 describes an integrated process involving atmospheric and vacuum distillation units, catalytic cracking unit, coker unit and reforming unit. Here the crude oil is routed to ADU & VDU for separation to gas fraction, liquid fraction, vacuum gas oil fraction and a vacuum residuum fraction. Vacuum gas oil fraction is routed to catalytic cracking unit and vacuum residue to coker unit. Liquid fraction from VDU, catalytic cracker & delayed coker and C3 paraffins, C4 paraffins are routed to steam cracker.

U.S. Pat. No. 10,259,758B2 describes a process installation to convert crude oil into petrochemical products comprising of a CDU, where it is separated into gases fraction, resid, kerosene and gasoil. The resid fraction is send to resid upgradation unit and the gas oil is routed to fluid catalytic cracking unit. The distillate from resid unit along with kerosene and gasoil stream is send to aromatic ring opening unit and LPG produced in the integrated process is send to olefin synthesis unit for production of lighter olefins.

US2013/0292299 describes an integrated ebullated bed and hydrotreater for whole crude oil upgrading. The crude oil is first flashed into lighter components which are sent for hydrotreating in a fixed bed hydrotreater unit. The heavy atmospheric residue is hydrotreated in an ebullated bed hydrotreater reactor. Distillates from the hydrotreater and unconverted residue from ebullated bed reactions are combined to form a synthetic crude oil stream.

WO2014/062465 describes a process for high severity catalytic cracking of crude oil. The crude oil is separated into high boiling fraction and low boiling fraction and are separately processed in two downer type of reactors. The deactivated catalyst from both vessels are regenerated in a common regenerator vessel.

US 2015/0321975 provides a process for producing aromatics from a hydrocarbon source in the presence of supercritical water. Supercritical water is used as an alternate to catalysts, which are not stable at these conditions. The dominant source of BTX aromatics are heavy aromatic compounds with single aromatic core with alkyl side chains.

US2013/0197284 describes an integrated hydrotreating, solvent deasphalting and steam pyrolysis process for complete conversion of crude oil. Here, crude oil after pretreatment is sent to hydrotreater and thereafter processed in solvent deasphalting unit. Deasphalter unit products are thermally converted in a steam Pyrolysis process.

US2016/0122668 describes an integrated slurry hydroprocessing and steam Pyrolysis process for production of olefins and aromatic petrochemical feedstocks from crude oil feedstock. Crude oil is hydro processed to produce effluent rich in hydrogen content and the said effluent is then routed to steam Pyrolysis unit to cause thermal cracking reactions. Mixed product stream is separated, and the olefins and aromatic products are recovered.

WO2013/112967 describes an integrated solvent deasphalting, hydrotreating and pyrolysis processes for direct processing of crude oil to produce olefins, petrochemical feedstocks and aromatics. Here, crude oil after pretreatment is sent to the solvent deasphalting unit and the deasphalted oil is routed to the hydrotreater unit. The hydrotreated material is then sent to a Pyrolysis unit for cracking into lighter products. Olefins and aromatic products are recovered from the mixed product stream.

US2019/0256786A1 relates to a process and system for complete conversion of crude oils by integrating delayed coking process, high severity catalytic cracking process and naphtha cracking processes along with olefin recovery section, aromatic recovery section and gasifier section to maximize the crude oil conversion to valuable products like light olefins, aromatics, and chemicals. The resid upgradation of heavy cut i.e., 370+ cut is through DCU and only LCO stream is utilized using selective mild hydrocracking process.

Conventionally, the Light Cycle Oil (LCO) product from the catalytic cracking unit as well as the Light Coker Gasoil (LCGO) from Delayed Coker Unit are normally send for producing Diesel product whereas in the present invention, a novel 'selective mild hydrocracking aromatic production unit' is employed which selectively cracks the polyaromatics to produce aromatic molecules like xylene while producing a small fraction of diesel. Also, the present process effectively distributes the LCGO stream to cracking process which produces light olefins along with aromatics as well as to selective mild hydrocracking process for aromatic production. The present process also provides a route for further conversion of LCO range streams produced from Catalytic Naphtha cracker unit to aromatics by making use of selective mild hydrocracking process. The present process achieves high conversion of naphtha streams including that produced from residue slurry hydrocracking process, selective mild hydrocracking process and also the paraffinic raffinate from aromatic recovery unit. The present process also enables to achieve higher conversions along with product qualities produced from high severity fluid catalytic cracking process by feeding the Hydrotreated streams from crude as well as residue slurry hydrocracking processes and Delayed Coker. The present process has high conversion of crude oil to light olefins and aromatics and maximizes extraction of value-added products from heavy residue through resid slurry hydrocracking, Delayed coking, Gasification and Syngas to Olefin conversion, with an option to withdraw coke from Delayed Coker unit as high value product.

SUMMARY OF THE PRESENT INVENTION

In an aspect of the present invention, provides an improved process for converting crude oil to high value petrochemicals products, the process comprising:

i. charging the crude oil to a Desalter unit to obtain a desalted crude oil;

ii. fractionating the desalted crude oil in a primary fractionation section to obtain straight run fractions namely, upper Light cut having boiling points below 350° C., Middle cut having boiling point in the range of 350-560° C. and Lower heavy cut having boiling point above 560° C.;

iii. routing the Lower heavy cut to a first Resid upgradation unit to obtain Fuel gas (FG) and LPG, Naphtha having boiling point in the range of $C_5$ to 140° C., Light Gasoil (LGO) having boiling point in the range of 140-370° C., Heavy Gasoil (HGO) having boiling point in the range of 370-560° C. and unconverted Pitch having boiling point above 560° C. by Residue Slurry Hydrocracking;

iv. routing the Middle cut from Primary fractionator, HGO from first Resid upgradation unit and Heavy Coker Gas oil (HCGO) from a second Resid upgradation unit to a Hydrotreater Unit to obtain a combined Hydrotreated Gasoil stream v. routing the combined Hydrotreated Gasoil stream to a High severity Fluid Catalytic Cracking Unit (FCCU), to obtain FG and LPG, Naphtha having boiling point in the range of $C_5$ to 210° C., Light Cycle Oil (LCO) having boiling point in the range of 210 to 340° C. and Clarified oil (CLO) with boiling point above 340° C.;

vi. routing the unconverted Pitch from first Resid upgradation unit and CLO from FCCU to second Resid upgradation unit for Delayed Coking reactions to obtain FG and LPG, Coker Naphtha with boiling point in the range of $C_5$ to 140° C., Light Coker Gas oil (LCGO) having boiling point in the range of 140 to 370° C., Heavy Coker Gas oil (HCGO) having boiling point in the range of 370 to 540° C. and Coke;

vii. withdrawing a part of the Coke as high value Coke product and routing the remaining Coke to a Coke Gasifier unit where it is converted to syngas, and syngas is converted to olefins using Syngas to Methanol (STM) and Methanol to Olefins (MTO) processes;

viii. splitting the LCGO stream from second Resid upgradation unit into two parts on mass basis without altering the boiling range (140-370° C.) and routing first part of the same along with Light Cycle Oil from high severity FCC unit and Light Cycle Oil boiling in the range of 210 to 340° C. recycled from Catalytic Naphtha Cracker unit, to Selective Mild Hydrocracking unit (SMHC) to obtain Fuel Gas, LPG, Light cut having boiling in the range of $C_5$ to 90° C., Middle cut having boiling point in the range of 90 to 180° C. and Bottom cut having boiling point above 180° C.;

ix. routing upper Light cut having boiling point below 350° C. from Primary fractionation section, Naphtha having boiling point in the range of $C_5$ to 140° C. from first and second Resid upgradation units, Light cut having boiling point in the range of $C_5$ to 90° C. from SMHC unit, LGO from first Resid upgradation unit, Naphtha having boiling point in the range of $C_5$ to 210° C. from FCCU and second part of the LCGO stream from second Resid upgradation unit to Catalytic Naphtha cracker unit to obtain FG, LPG and Gasoline having boiling point in the range of $C_5$ to 210° C., Light Cycle Oil having boiling point in the range of 210 to 340° C. and Clarified oil (CLO) having boiling point above 340° C.;

x. routing FG and LPG from various units including Methanol to Olefin conversion unit to Olefin recovery section having $C_2$ splitter, Propylene Recovery Unit (PRU) and $C_4$ splitter, to obtain ethane, ethylene, propylene, butylenes and $C_3/C_4$ paraffins; and xi. routing $C_3$ paraffins stream to a propane dehydrogenation unit to obtain propylene; and xii. routing the paraffinic $C_4$ back to Catalytic Naphtha cracker unit for complete conversion; and xiii. routing the Middle cut having boiling point in the range of 90 to 180° C. from Selective mild hydrocracking unit and gasoline having boiling point in the range of $C_5$ to 210° C. from Catalytic naphtha cracker unit to Aromatic recovery unit to obtain an extract stream containing Benzene, Toluene, Xylene and a raffinate stream containing paraffins; and xiv. routing the paraffinic raffinate stream to the Catalytic Naphtha cracker unit as the recycle stream.

In another embodiment of the present invention, the desalted crude oil is fractionated via unit selected from atmospheric distillation unit, vacuum distillation unit or a combination thereof. In another embodiment of the present invention, the Primary fractionation section comprises of an Atmospheric distillation unit operating at a pressure in the range of 1-2 $Kg/cm^2(g)$ and top temperature in the range of 150 to 250° C. preferably in the range of 190 to 210° C.; and a Vacuum distillation unit operates at pressure in the range of 0.01 to 0.05 $Kg/cm^2(g)$.

In another embodiment of the present invention, the processing of Light Coker Gas Oil from first resid upgradation unit, light cycle from Catalytic Naphtha cracker unit and Light Cycle Oil from using Selective Mild Hydrocracking increases the yield of aromatics and light olefins.

In another embodiment of the present invention, the mass ratio at which the LCGO stream from second Resid upgradation unit is split, is selected from the range of 10:90 to 90:10 for routing to SMHC and Catalytic Naphtha Cracker Units.

In an embodiment of the present invention, the upper light cut with boiling point below 350° C. from primary fractionation section is optionally routed to Thermal Naphtha cracker unit via Naphtha hydrotreater unit to remove Sulfur and Nitrogen impurities; and the upper light cut with boiling point below 350° C. from primary fractionation section comprises Straight Run Naphtha, Kerosene, Light Gas Oil, Heavy Gas Oil and middle cut comprises of Vacuum diesel and Vacuum Gas Oil (VGO) and Lower heavy cut comprises Vacuum Residue (VR), respectively.

In an embodiment of the present invention, high value coke has sulphur in range of 1-3 wt % and sponge structure for use as graphite grade coke.

In an embodiment of the present invention, a part of the high value coke is withdrawn as a product depending upon requirement and the remaining coke is optionally sent to the Gasification section.

In another embodiment of the present invention discloses that the first Resid Upgradation Unit is a Residue Hydrocracking Unit which uses oil soluble liquid catalyst comprising a Ni (1-5 wt %) and Mo (95-99 wt %).

In another embodiment of the present invention, the Naphtha Hydrotreater Unit is operated at temperature in the range of 300-360° C. and at a pressure in range of 10-20 bar.

In another embodiment of the present invention, the selective mild hydrocracking unit has two reactors for hydrotreating and selective mild hydrocracking respectively.

In another embodiment of the present invention, the Second Resid upgradation unit is a Delayed Coker Unit, and the Coke Drums are operated at temperature in the range of 470 to 520° C., preferably between 480° C. to 500° C. and desired operating pressure ranging from 0.5 to 5 $Kg/cm^2$ (g) preferably between 0.6 to 3 $Kg/cm^2$ (g) and residence time in the range of 10 to 32 hours.

In another embodiment of the present invention, the High severity FCC unit operates at a high reactor outlet temperature of 550 to 650° C., preferably between 580 to 620° C., Reactor pressure in the range of 0.7 to 2.5 $Kg/cm^2$ (g), preferably in the range of 0.8 to 1.5 $Kg/cm^2$ (g) and the catalyst to oil ratio in the range of 10 to 25, preferably in the range of 15 to 20; and the Catalytic Naphtha Cracker Unit operates at a reactor outlet temperature of 580 to 670° C., preferably between 590 to 630° C., reactor pressure in the range of 0.7 to 2.5 $Kg/cm^2$ (g), preferably in the range of 0.8 to 1.5 $Kg/cm^2$ (g) and the catalyst to oil ratio in the range of 15 to 30, preferably in the range of 15 to 25.

In another embodiment of the present invention, the first Resid upgradation unit is a Residue Slurry Hydrocracker Unit which operate at a pressure in the range of 45 to 80 $Kg/cm^2$ (g), preferably in the range of 50 to 70 $Kg/cm^2$ (g) and temperature in the range of 360 to 450 C, preferably in the range of 390 to 420° C.

In another embodiment of the present invention, the coke Gasifier operates with $1^{st}$ stage as a Low temperature fluidized gasifier and $2^{nd}$ stage as high temp entrained Gasifier with the temperature of both stages in the range of 750 to 825° C. and 1400 to 1500° C. respectively and residence time in the range of 50 to 100 and 2 to 5 seconds.

In another aspect of the present invention, a system to implement process for converting crude oil to high value petrochemicals products, the system comprising:

i. a desalter unit to obtain a desalted crude oil from a crude oil;

ii. a primary fractionation section comprising atmospheric distillation unit and vacuum distillation unit to receive the desalted crude oil from the desalter unit and separate the desalted crude oil into an upper cut having boiling point below 350° C., middle cut having boiling point in the range of 350-560° C. and lower heavy cut having boiling point above 560° C.;

iii. a Slurry hydrocracker unit as first resid upgradation unit to receive lower heavy cut and hydrocracking it to generate FG, LPG, Naphtha, LGO, HGO and unconverted Pitch;

iv. a Delayed Coker Unit as second upgradation unit to receive and upgrading unconverted Pitch and FCC Clarified Oil by Delayed Coking to generate FG, LPG, Coker Naphtha, LCGO, HCGO and solid petroleum coke;

v. a Coke Gasifier Unit to receive the solid petroleum coke produced in the second upgradation unit for converting it to Syngas;

vi. a Syngas to Methanol conversion unit to convert Syngas from Coke Gasifier Unit to Methanol vii. a Methanol to olefin unit to convert the methanol to light olefins viii. a Hydrotreater Unit to receive Middle cut from primary fractionation section, HGO from Slurry hydrocracking unit and Heavy Coker Gas Oil from Delayed Coker Unit to generate a combined Hydrotreated gasoil stream;

ix. a High Severity Catalytic Cracker Unit to receive combined Hydrotreated gasoil stream from Hydrotreater Unit to generate a Clarified Oil stream, gaseous products containing FG and LPG, Light Cycle Oil and Naphtha;

x. a Selective mild hydrocracking unit (SMHC) consisting of hydrotreating and selective mild hydrocracking reactors, to receive Light Cycle Oils from High Severity FCC unit and Catalytic Naphtha Cracker Unit and a part of Light Coker Gas Oil from Delayed Coker unit to generate FG and LPG, Light cut, Middle cut and Bottom cut;

xi. a Catalytic Naphtha Cracker Unit to receive the upper cut from the primary fractionation section, Paraffinic Raffinate from Aromatic recovery unit, Light cut from SMHC unit, Naphtha and LGO from Slurry Hydrocracker Unit, Naphtha from FCC unit, Naphtha and a part of LCGO from Delayed Coker Unit and C4 paraffins recycle to undergo catalytic cracking to generate lighter olefins & aromatics;

xii. a $C_2$ splitter and Propylene Recovery Unit (PRU) to receive the FG and LPG from first resid upgradation unit, second resid upgradation unit, High Severity FCC Unit, Catalytic Naphtha cracker Unit, Methanol to Olefin conversion unit and selective mild hydrocracking unit to generate ethane, ethylene, propylene, butylenes and $C_3$, $C_4$ paraffinic stream; and xiii. a propane dehydrogenation unit to receive $C_3$ paraffin stream and generate propylene.

xiv. an aromatic recovery unit to receive Middle cut having boiling point in the range of 90 to 180° C. from SMHC unit and gasoline from Catalytic naphtha cracker unit to obtain an Extract stream containing Benzene, Toluene, Xylene and a Raffinate stream containing paraffins In another embodiment of the present invention, the system is optionally provided with a Naphtha Hydrotreater unit for receiving fully or a part of the upper cut and other naphtha streams for removing the impurities such as Sulfur and Nitrogen and an optional Steam cracker unit to receive treated naphtha stream to generate lighter olefins, pyrolyzed gasoline, and ethylene tar (Pyrolytic Fuel oil) by thermal cracking.

OBJECTIVES OF THE PRESENT INVENTION

It is a primary objective of the invention to provide a process and system for improving the selectivity for production of light olefins and aromatics.

It is another objective of the invention to achieve higher conversions along with product qualities produced from high severity fluid catalytic cracking process by feeding the Hydrotreated streams from crude as well as residue slurry hydrocracking processes and Delayed Coker It is yet another objective of the invention to effectively distribute the LCGO stream to cracking process which produces light olefins along with aromatics as well as to selective mild hydrocracking process for aromatic production It is further objective of the present invention to provide a process for maximizing extraction of value-added products from heavy residue through resid slurry hydrocracking, Delayed coking, Gasification and Syngas to Olefin conversion.

It is another objective of the invention to high conversion of naphtha streams including that produced from residue slurry hydrocracking process, selective mild hydrocracking process and also the paraffinic raffinate from aromatic recovery unit It is further objective of the present invention to minimize/reduce the diesel production from crude oil.

Further objective of the invention is to produces gas oils with low sulfur, nitrogen content to increase catalyst life and reduces operating cost.

It is yet another objective of the present invention to provide for an option to produce high value coke from Delayed Coker Unit

DESCRIPTION OF THE INVENTION

Figure 1:
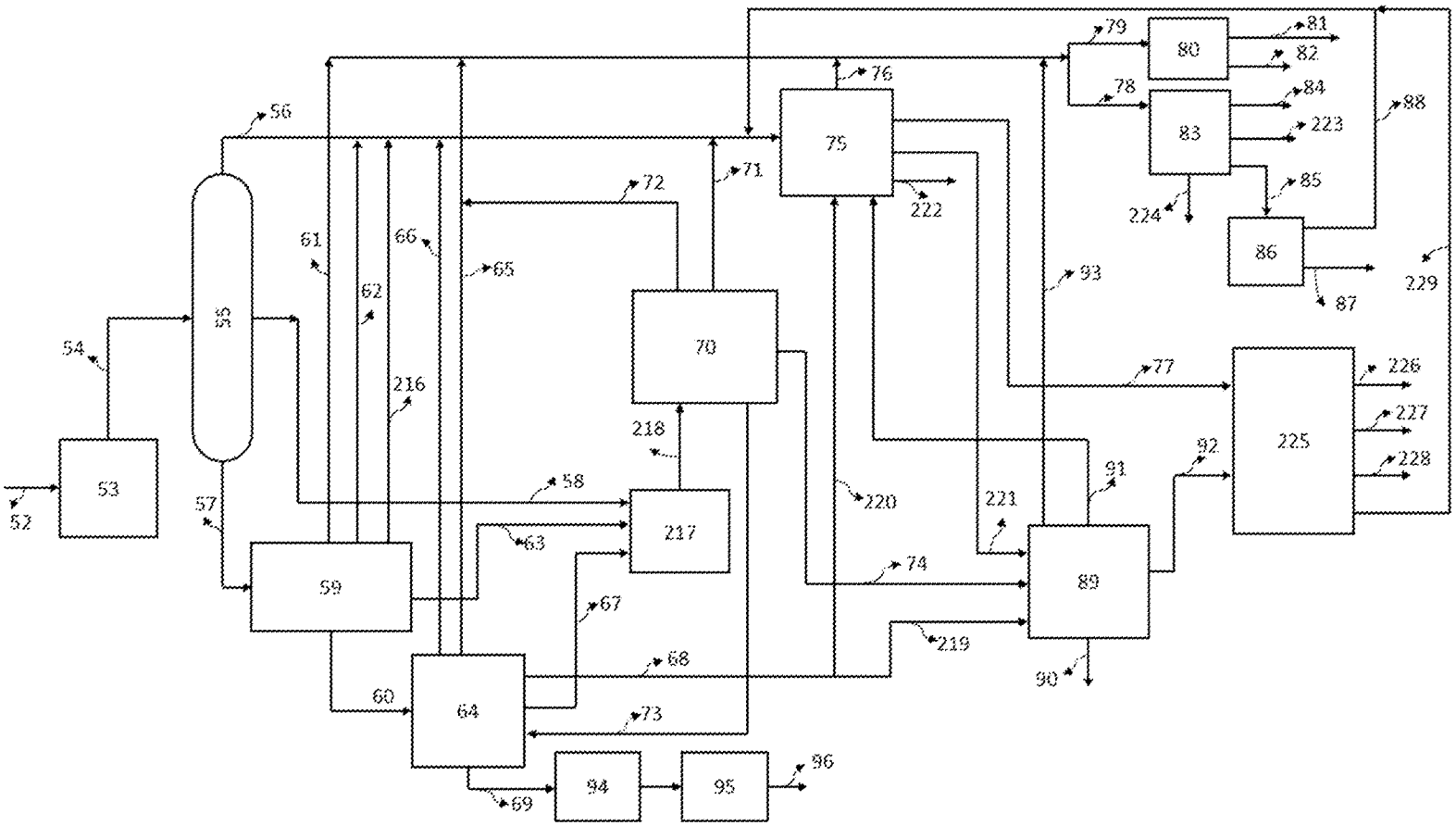
FIG. 1 illustrates schematic of integrated process scheme for converting crude oil to petrochemicals or system of present invention.

While the invention is susceptible to various modifications and alternative forms, specific embodiment thereof will be described in detail below. It should be understood, however that it is not intended to limit the invention to the particular forms disclosed, but on the contrary, the invention is to cover all modifications, equivalents, and alternative falling within the scope of the invention as defined by the appended claims.

The following description is of exemplary embodiments only and is not intended to limit the scope, applicability, or configuration of the invention in any way. Rather, the following description provides a convenient illustration for implementing exemplary embodiments of the invention. Various changes to the described embodiments may be made in the function and arrangement of the elements described without departing from the scope of the invention.

Feedstock

The liquid hydrocarbon feedstock that can be used in the process is crude oil or crude oil blends and/or crude oil fractions thereof and/or synthetic crude oils and/or oil sand bitumens and/or oils derived from same having Conradson Carbon Residue (CCR) content less than 15 wt % and in particular ranging from 1 to 15 wt %. The feed blend may also comprise of waste plastic pyrolysis oil and/or biomass pyrolysis oil as part of the blend within a limit of up to 50 wt %.

Process Conditions

In the process of present invention, atmospheric distillation unit operates at pressure in the range of 1-2 $Kg/cm^2$(g) and top temperature in the range of 150 to 250° C. preferably in the range of 190 to 210° C. while vacuum distillation unit operates at pressure in the range of 0.01 to 0.05 $Kg/cm^2$(g). These process conditions are to be fine-tuned to enable separation of lighter boiling (<200° C.) naphtha range compounds from the crude.

Coke drums in the delayed coking section of the process may be operated at a higher severity with desired operating temperature ranging from 470 to 520° C., preferably between 480° C. to 500° C. and desired operating pressure ranging from 0.5 to 5 $Kg/cm^2$ (g) preferably between 0.6 to 3 $Kg/cm^2$ (g). The residence time provided in coke drums is kept in the range of 10 to 32 hours.

High severity FCC unit is operated at a high reactor outlet temperature of 550 to 650° C., preferably between 580 to 620° C. Reactor pressure shall vary in the range of 0.7 to 2.5 $Kg/cm^2$ (g), preferably in the range of 0.8 to 1.5 $Kg/cm^2$ (g). The catalyst to oil ratio is selected from the range of 10 to 25, preferably in the range of 15 to 20.

The catalytic naphtha cracker unit as mentioned in the present invention is a circulating fluidized bed unit for continuous catalyst regeneration and operates at a reactor outlet temperature of 580 to 670° C., preferably between 590 to 630° C. Reactor pressure shall vary in the range of 0.7 to 2.5 $Kg/cm^2$ (g), preferably in the range of 0.8 to 1.5 $Kg/cm^2$ (g). The catalyst to oil ratio is selected from the range of 15 to 30, preferably in the range of 15 to 25.

Thermal Naphtha cracking unit is operated in presence of steam in the ratio of 0.4 to 1 with feedstock and carried at a higher reactor temperature of 800 to 900° C. at a residence time in the range of 0.1 to 0.5 seconds.

Naphtha hydrotreater unit for obtaining hydrotreated naphtha, feed for Thermal naphtha cracker is operated at temperature in the range of 300-360° C. at a pressure of 10-20 bar in presence of hydrogen.

Selective Mild Hydrocracking Aromatic production unit involves hydrotreating and selective mild hydrocracking steps being carried out in two reactors. The reactors operate at a pressure in the range of 45 to 80 Bar, preferably in the range of 50 to 70 bars and temperature in the range of 360 to 450° C., preferably in the range of 390 to 420° C. in presence of hydrogen.

The residue slurry hydrocracker unit is operated in the temperature range of 250-550° C. and pressure in the range of 40-250 bar in presence of hydrogen.

Gasifier unit for conversion of coke into syngas is operated at and Syngas to Methanol & Methanol to olefins is operated with $1^{st}$ stage as a Low temperature fluidized gasifier and $2^{nd}$ stage as high temp entrained gasifier. The temperature of both stages in the range of 750-825° C. and 1400-1500° C. respectively and residence time in the range of 50-100 and 2-5 sec respectively.

Catalyst

In the process scheme of present invention, no catalysts are employed in Atmospheric/vacuum distillation units, delayed coker units and thermal naphtha cracker units. High severity FCC unit employs a circulating fluidized bed reactor configuration and a catalyst mixture containing 'large pore bottoms selective active material' of pore size more than 50 Å, Y/REY/USY/RE-USY zeolites of medium pore size of 7 to 11 Å and shape selective pentasil zeolite components. The catalytic naphtha cracker unit also employs a circulating fluidized bed reactor configuration and uses a catalyst composition, with predominantly shape selective pentasil zeolite. Naphtha Hydrotreater uses CoMo/NiMo Catalyst while Residue Hydrocracking unit employs oil soluble liquid catalyst comprises a Ni (1-5 wt %) and Mo (95-99 wt %) organometallic compound in a suitable solvent such as toluene. Selective Mild Hydrocracking Aromatic production unit employs a bifunctional catalyst based on Nickel and Molybdenum.

Process and System Flow Scheme

In the process and system of present invention as depicted in FIG. 1, an improved process for converting crude oil to high value petrochemicals products, the process comprising charging the crude oil (52) to a Desalter unit (53) to obtain a desalted crude oil. The desalted crude oil (54) is then fractionated in a Primary fractionation section (55) to obtain straight run fractions namely, upper Light cut having boiling point below 350° C. (56), Middle cut having boiling point in the range of 350-560° C. (58) and Lower heavy cut having boiling point above 560° C. (57). The Lower heavy cut (57) is routed to a first Resid upgradation unit (59) to obtain Fuel gas (FG) and LPG (61), Naphtha having boiling point in the range of $C_5$ to 140° C. (62), Light Gas Oil (LGO) boiling in the range of 140-370° C. (216), Heavy Gas Oil (HGO) boiling in the range of 370-560° C. (63) and unconverted Pitch boiling above 560° C. (60) by Slurry Hydrocracking. The Middle cut from Primary fractionator, HGO from first Resid upgradation unit and Heavy Coker Gas oil (HCGO) (67) from a second Resid upgradation unit (64) is then routed to a Hydrotreater Unit (217) to obtain a combined Hydrotreated Gasoil stream (218). The combined Hydrotreated Gasoil stream (218) is routed to a High severity Fluid Catalytic Cracking Unit (FCCU) (70), to obtain FG and LPG (72), Naphtha having boiling point in the range of $C_5$ to 210° C. (71), Light Cycle Oil (LCO) boiling in the range of 210 to 340° C. (74) and Clarified oil (CLO) having boiling point above 340° C. (73). The unconverted Pitch from first Resid upgradation unit and CLO from FCC unit to second Resid upgradation unit for undergoing Delayed Coking reactions to obtain FG and LPG (65), Coker Naphtha having boiling point in the range of $C_5$ to 140° C. (66), Light Coker Gas oil (LCGO) boiling in the range of 140 to 370° C. (68), Heavy Coker Gas oil (HCGO) boiling in the range of 370 to 540° C. (67) and Coke (69). Coke is then fed to a Coke Gasifier unit (94) where it is converted to syngas, and syngas is converted to olefins (96) using Syngas to Methanol (STM) and Methanol to Olefins (MTO) processes (95). The LCGO stream (68) from second Resid upgradation unit is split into two parts on mass basis without altering the boiling range (140-370° C.) and routing first part (219) of the same along with Light Cycle Oil (74) from high severity FCC unit and Light Cycle Oil boiling in the range of 210 to 340° C. (221) recycled from Catalytic Naphtha Cracker unit (75) to Selective Mild Hydrocracking unit (SMHC) (89) to obtain Fuel Gas and LPG (93), Light cut having boiling point in the range of $C_5$ to 90° C. (91), Middle cut having boiling point in the range of 90 to 180° C. (92) and Bottom cut having boiling point above 180° C. (90). The Upper Light cut having boiling point below 350° C. (56) from Primary fractionation section, Naphtha having boiling point in the range of $C_5$ to 140° C. (62 & 66) from first and second Resid upgradation units, Light cut having boiling point in the range of C5 to 90° C. (91) from SMHC unit, LGO (216) from first Resid upgradation unit, Naphtha having boiling point in the range of $C_5$ to 210° C. (71) from FCCU and second part of the LCGO stream (220) from second Resid upgradation unit is routed to Catalytic Naphtha cracker unit (75) to obtain FG and LPG (76) and Gasoline boiling point in the range of $C_5$ to 210° C. (77), Light Cycle Oil boiling point in the range of 210 to 340° C. (221) and Clarified oil (CLO) boiling point above 340° C. (222). The FG (79) and LPG (78) from various units including Methanol to Olefin conversion unit to Olefin recovery section having $C_2$ splitter (80), Propylene Recovery Unit (PRU) & C4 splitter (83), to obtain ethane (81), ethylene (82), propylene (84), butylenes (223) and $C_3$ paraffins (85) & $C_4$ paraffins (224). The $C_3$ paraffins stream (85) is then routed to a propane dehydrogenation unit (86) to obtain propylene (87); and routing the paraffinic C4 (88) back to Catalytic Naphtha cracker unit (75) for complete conversion. The Middle cut boiling point in the range of 90 to 180° C. (92) from Selective mild hydrocracking unit and gasoline boiling point in the range of $C_5$ to 210° C. (77) from Catalytic naphtha cracker unit to Aromatic recovery unit (225) to obtain an extract stream containing Benzene (226), Toluene (227), Xylene (228) and a raffinate stream containing paraffins (229); and routing the paraffinic raffinate stream (229) to the Catalytic Naphtha cracker unit as the recycle stream.

Figure 2:
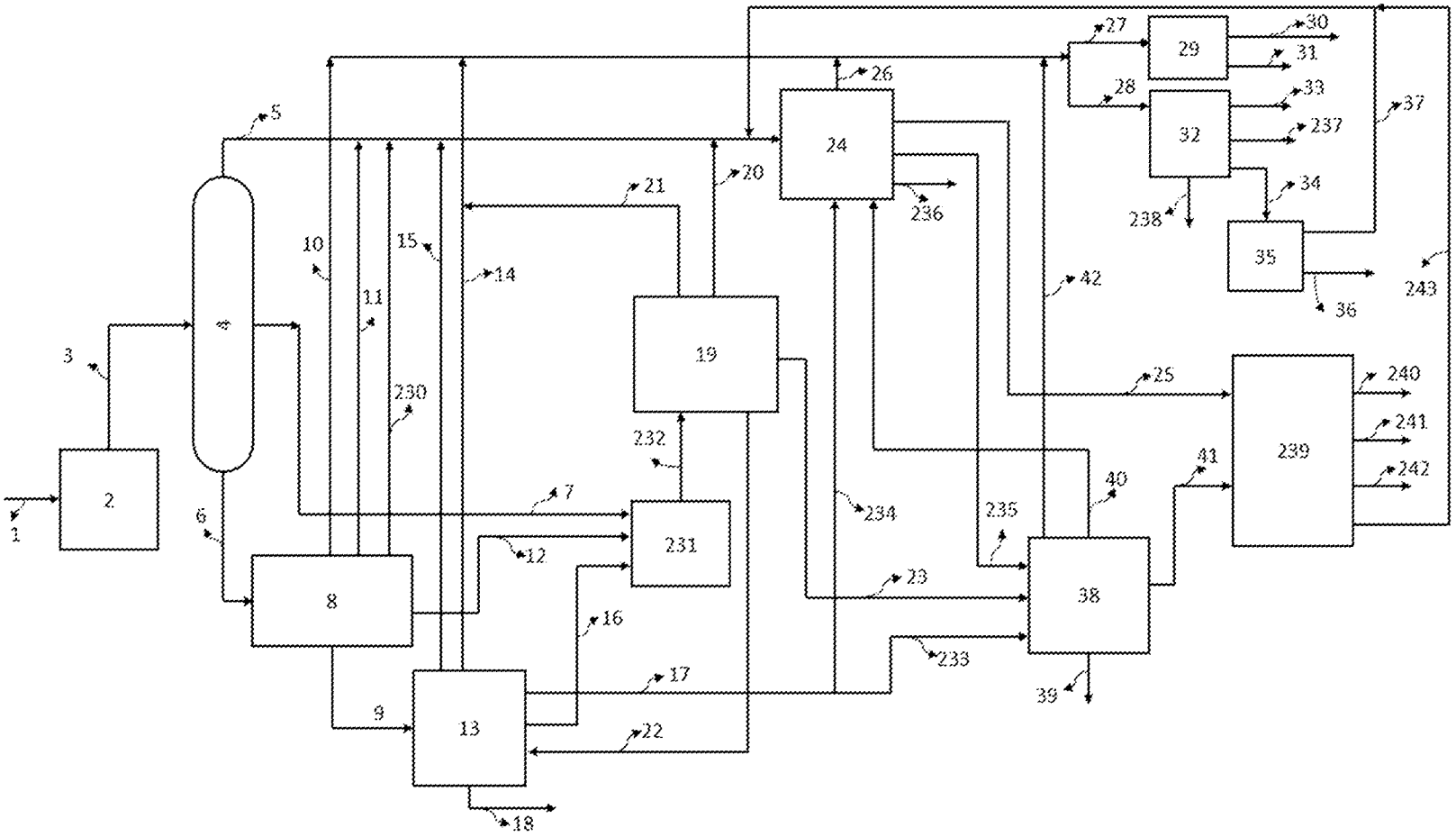
FIG. 2 illustrates schematic of another embodiment of present invention for crude to chemical processing scheme.

In another feature of the present invention as depicted in FIG. 2, an improved process for converting crude oil to high value petrochemicals products, the process comprising charging the crude oil (1) to a Desalter unit (2) to obtain a desalted crude oil. The desalted crude oil (3) is then fractionated in a Primary fractionation section (4) to obtain straight run fractions namely, upper Light cut boiling point below 350° C. (5), Middle cut boiling point in the range of 350-560° C. (7) and Lower heavy cut boiling point above 560° C. (6). The Lower heavy cut (6) is routed to a first Resid upgradation unit (8) to obtain Fuel gas (FG) and LPG (10), Naphtha boiling point in the range of $C_5$ to 140° C. (11), Light Gas Oil (LGO) boiling point in the range of 140-370° C. (230), Heavy Gas Oil (HGO) boiling point in the range of 370-560° C. (12) and unconverted Pitch boiling point above 560° C. (9) by Slurry Hydrocracking. The Middle cut from Primary fractionator, HGO from first Resid upgradation unit and Heavy Coker Gas oil (HCGO) (16) from a second Resid upgradation unit (13) is then routed to a Hydrotreater Unit (231) to obtain a combined Hydrotreated Gasoil stream (232). The combined Hydrotreated Gasoil stream (232) is routed to a High severity Fluid Catalytic Cracking Unit (FCCU) (19), to obtain FG and LPG (21), Naphtha boiling in the range of $C_5$ to 210° C. (20), Light Cycle Oil (LCO) boiling point in the range of 210 to 340° C. (23) and Clarified oil (CLO) boiling above 340° C. (22). The unconverted Pitch from first Resid upgradation unit and CLO from FCC unit to second Resid upgradation unit for undergoing Delayed Coking reactions to obtain FG and LPG (14), Coker Naphtha boiling in the range of $C_5$ to 140° C. (15), Light Coker Gas oil (LCGO) boiling in the range of 140 to 370° C. (17), Heavy Coker Gas oil (HCGO) boiling in the range of 370 to 540° C. (19) and Coke (18). The LCGO stream (17) from second Resid upgradation unit is split into two parts on mass basis without altering the boiling range (140-370° C.) and routing first part (233) of the same along with Light Cycle Oil (23) from high severity FCC unit and Light Cycle Oil boiling in the range of 210 to 340° C. (235) recycled from Catalytic Naphtha Cracker unit (24) to Selective Mild Hydrocracking unit (SMHC) (38) to obtain Fuel Gas and LPG (42), Light cut boiling in the range of $C_5$ to 90° C. (40), Middle cut boiling in the range of 90 to 180° C. (41) and Bottom cut boiling point above 180° C. (39). The Upper Light cut boiling point below 350° C. (5) from Primary fractionation section, Naphtha boiling point in the range of C5 to 140° C. (11 & 15) from first and second Resid upgradation units, Light cut boiling point in the range of C5 to 90° C. (40) from SMHC unit, LGO (230) from first Resid upgradation unit, Naphtha boiling point in the range of $C_5$ to 210° C. (20) from FCCU and second part of the LCGO stream (234) from second Resid upgradation unit is routed to Catalytic Naphtha cracker unit (24) to obtain FG and LPG (26) and Gasoline boiling point in the range of $C_5$ to 210° C. (25), Light Cycle Oil boiling in the range of 210 to 340° C. (235) and Clarified oil (CLO) boiling point above 340° C. (236). The FG (27) and LPG (28) from various units including Methanol to Olefin conversion unit to Olefin recovery section having $C_2$ splitter (29), Propylene Recovery Unit (PRU) & $C_4$ splitter (32), to obtain ethane (30), ethylene (31), propylene (33), butylenes (237) and $C_3$ paraffins (34) & $C_4$ paraffins (238). The $C_3$ paraffins stream (34) is then routed to a propane dehydrogenation unit (35) to obtain propylene (36); and routing the paraffinic $C_4$ (37) back to Catalytic Naphtha cracker unit (24) for complete conversion. The Middle cut boiling point in the range of 90 to 180° C. (41) from Selective mild hydrocracking unit and gasoline boiling point in the range of $C_5$ to 210° C. (25) from Catalytic naphtha cracker unit to Aromatic recovery unit (239) to obtain an extract stream containing Benzene (240), Toluene (241), Xylene (242) and a raffinate stream containing paraffins (243); and routing the paraffinic raffinate stream (243) to the Catalytic Naphtha cracker unit as the recycle stream.

Figure 3:
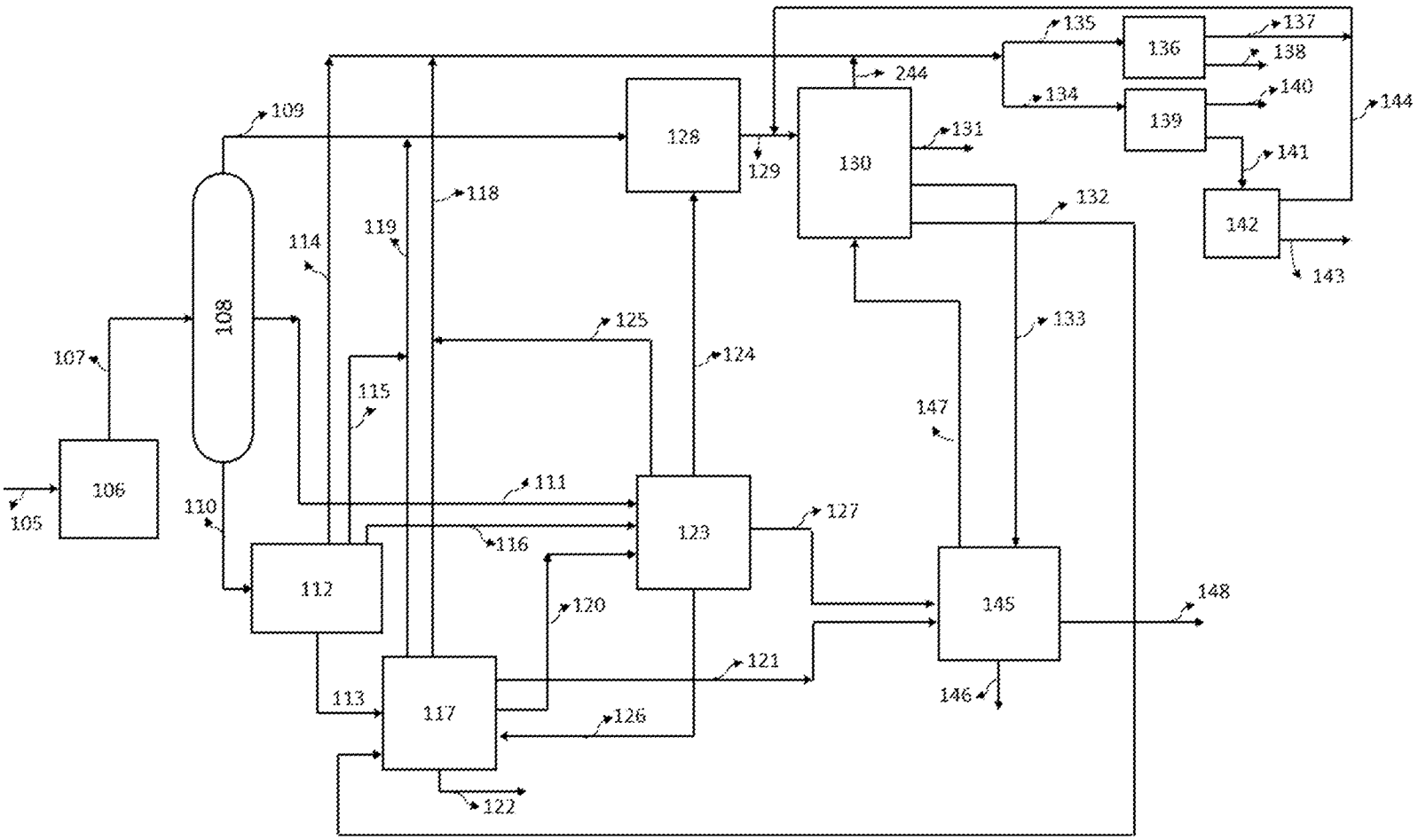
FIG. 3 illustrates schematic of embodiment of present invention for crude to chemical processing scheme or system including a Thermal Naphtha cracker unit.

In another feature of the present invention as depicted in FIG. 3, an improved process for converting crude oil to high value petrochemicals products, the process comprising charging the crude oil (105) to a Desalter unit (106) to obtain a desalted crude oil. The desalted crude oil (107) is then fractionated in a Primary fractionation section (108) to obtain straight run fractions namely, upper Light cut boiling point below 350° C. (109), Middle cut boiling point in the range of 350-560° C. (111) and Lower heavy cut boiling point above 560° C. (110). The Lower heavy cut (110) is routed to a first Resid upgradation unit (112) to obtain Fuel gas (FG) and LPG (114), Naphtha boiling point in the range of $C_5$ to 140° C. (115), Light Gas Oil (LGO) boiling point in the range of 140-370° C. & Heavy Gas Oil (HGO) boiling point in the range of 370-560° C. (116) and unconverted Pitch boiling point above 560° C. (113) by Slurry Hydrocracking. The unconverted Pitch from first Resid upgradation unit, CLO from FCC unit to second Resid upgradation unit (117) and Pyrolyzed Furl (PFO) boiling in the range of (350-530° C.) (132) for undergoing Delayed Coking reactions to obtain FG and LPG (118), Coker Naphtha boiling in the range of C5 to 140° C. (119), Light Coker Gas oil (LCGO) boiling in the range of 140 to 370° C. (121), Heavy Coker Gas oil (HCGO) boiling in the range of 370 to 540° C. (120) and Coke (122). The Middle cut from Primary fractionator (111), Light Gas Oil (LGO) boiling point in the range of 140-370° C. and Heavy Gas Oil (HGO) boiling point in the range of 370-560° C. (116) from first upgradation unit and Heavy Coker Gas oil (HCGO) (120) from a second Resid upgradation unit (117) is then routed to a High severity Fluid Catalytic Cracking Unit (FCCU) (123), to obtain FG and LPG (125), Naphtha boiling point in the range of C5 to 210° C. (124), Light Cycle Oil (LCO) boiling point in the range of 210 to 340° C. (127) and Clarified oil (CLO) boiling point above 340° C. (126). Light Cycle Oil (127) from high severity FCC unit and Pyrolyzed gasoline (133) recycled from Thermal Naphtha Cracker unit (133) to Selective Mild Hydrocracking unit (SMHC) (145) to obtain Light cut boiling point in the range of $C_5$ to 90° C. (148), Middle cut boiling point in the range of 90 to 180° C. (147) and Bottom cut boiling point above 180° C. (146). The Upper Light cut boiling point below 350° C. (109) from Primary fractionation section, Naphtha boiling point in the range of $C_5$ to 140° C. (115 & 119) from first and second Resid upgradation units, Naphtha boiling point in the range of $C_5$ to 210° C. (124) from FCCU is routed to Naphtha hydrotreater unit (128) to remove the impurities such as S, N in naphtha streams. The hydrotreated stream (129) is then routed to Thermal Naphtha cracker unit (130) to obtain FG and LPG (244) and lighter olefins (131), pyrolyzed gasoline (133) and ethylene tar commonly known as Pyrolyzed Fuel oil (132). The FG (135) & LPG (134) from various units including Methanol to Olefin conversion unit to Olefin recovery section having $C_2$ splitter (136) and Propylene Recovery Unit (PRU) & $C_4$ splitter (139) respectively to produce ethane (137) which is recycled back to Thermal Naphtha cracker unit, ethylene (138), propylene (140) and $C_4/C_3$ stream (141). The $C_4/C_3$ paraffins stream (141) is then routed to a propane dehydrogenation unit (142) to obtain propylene (143); and routing the paraffinic $C_4$ (144) back to Thermal Naphtha cracker unit (130) for complete conversion.

Figure 4:
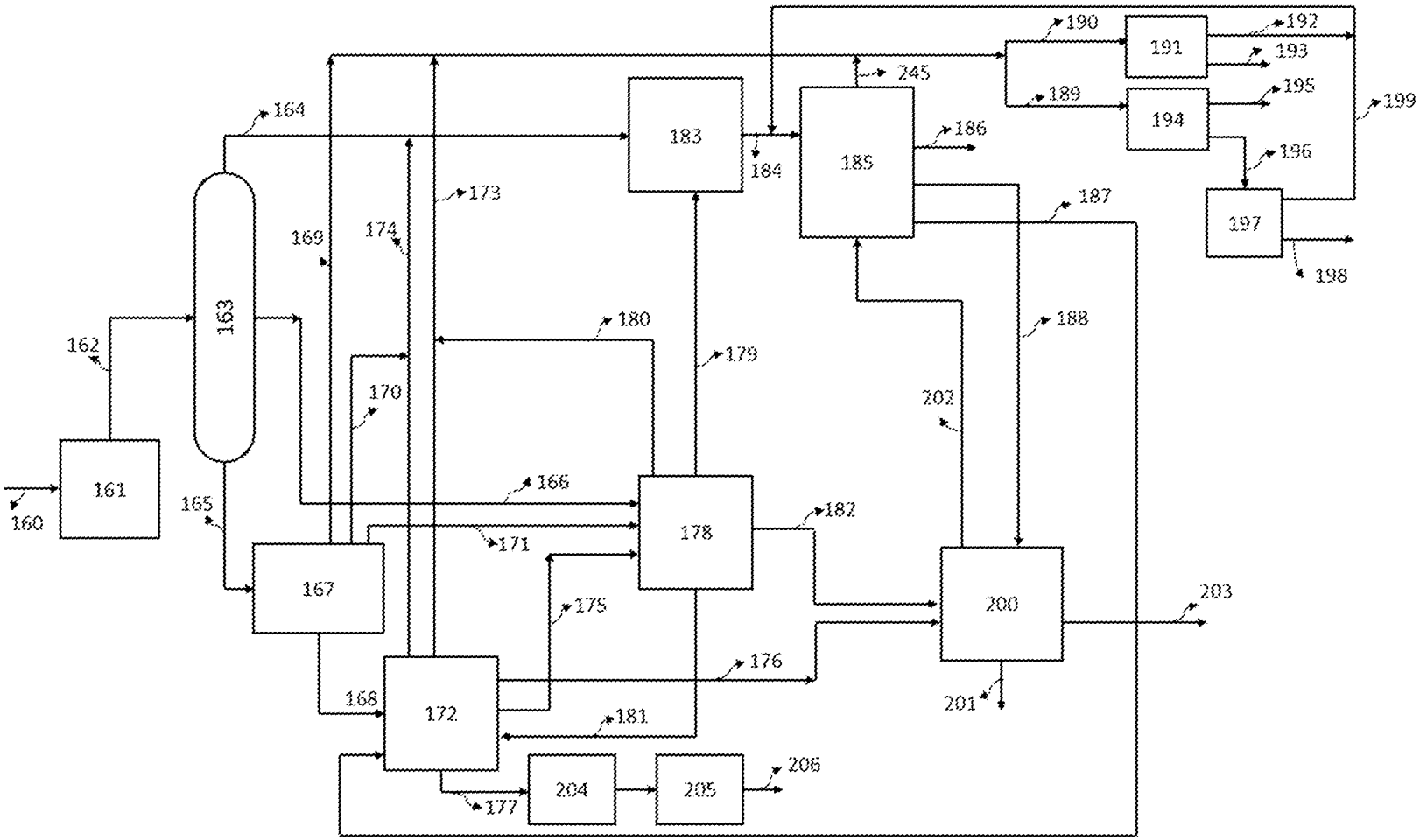
FIG. 4 illustrates schematic of another embodiment of present invention for crude to chemical processing scheme or system including a Thermal Naphtha cracker unit.

In another preferred feature of the present invention as depicted in FIG. 4, an improved process for converting crude oil to high value petrochemicals products, the process comprising charging the crude oil (160) to a Desalter unit (161) to obtain a desalted crude oil. The desalted crude oil (162) is then fractionated in a Primary fractionation section (163) to obtain straight run fractions namely, upper Light cut boiling point below 350° C. (164), Middle cut boiling point in the range of 350-560° C. (166) and Lower heavy cut boiling point above 560° C. (165). The Lower heavy cut (165) is routed to a first Resid upgradation unit (167) to obtain Fuel gas (FG) and LPG (169), Naphtha boiling point in the range of $C_5$ to 140° C. (170), Light Gas Oil (LGO) boiling point in the range of 140-370° C. and Heavy Gas Oil (HGO) boiling point in the range of 370-560° C. (171) and unconverted Pitch boiling point above 560° C. (168) by Slurry Hydrocracking. The unconverted Pitch from first Resid upgradation unit, CLO from FCC unit to second Resid upgradation unit (172) and Pyrolyzed Furl (PFO) boiling point in the range of (350-530° C.) (187) for undergoing Delayed Coking reactions to obtain FG and LPG (173), Coker Naphtha boiling point in the range of C5 to 140° C. (174), Light Coker Gas oil (LCGO) boiling point in the range of 140 to 370° C. (176), Heavy Coker Gas oil (HCGO) boiling point in the range of 370 to 540° C. (175) and Coke (177). Coke is then fed to a Coke Gasifier unit (204) where it is converted to syngas, and syngas is converted to olefins (206) using Syngas to Methanol (STM) and Methanol to Olefins (MTO) processes (205). The Middle cut from Primary fractionator (111), Light Gas Oil (LGO) boiling point in the range of 140-370° C. and Heavy Gas Oil (HGO) boiling point in the range of 370-560° C. (171) from first upgradation unit and Heavy Coker Gas oil (HCGO) (175) from a second Resid upgradation unit (172) is then routed to a High severity Fluid Catalytic Cracking Unit (FCCU) (178), to obtain FG and LPG (180), Naphtha boiling point in the range of $C_5$ to 210° C. (179), Light Cycle Oil (LCO) boiling point in the range of 210 to 340° C. (182) and Clarified oil (CLO) boiling point above 340° C. (181). Light Cycle Oil (182) from high severity FCC unit and Pyrolyzed gasoline (188) recycled from Thermal Naphtha Cracker unit (185) to Selective Mild Hydrocracking unit (SMHC) (200) to obtain Light cut boiling point in the range of $C_5$ to 90° C. (203), Middle cut boiling point in the range of 90 to 180° C. (202) and Bottom cut boiling above 180° C. (201). The Upper Light cut boiling point below 350° C. (164) from Primary fractionation section, Naphtha boiling point in the range of $C_5$ to 140° C. (170 & 174) from first and second Resid upgradation units, Naphtha boiling point in the range of $C_5$ to 210° C. (179) from FCCU is routed to Naphtha hydrotreater unit (183) to remove the impurities such as S, N in naphtha streams. The hydrotreated stream (184) is then routed to Thermal Naphtha cracker unit (185) to obtain FG and LPG (245) and lighter olefins (186), pyrolyzed gasoline (188) and ethylene tar commonly known as Pyrolyzed Fuel oil (189). The FG (190) & LPG (189) from various units including Methanol to Olefin conversion unit to Olefin recovery section having $C_2$ splitter (191) and Propylene Recovery Unit (PRU) and $C_4$ splitter (194) respectively to produce ethane (192) which is recycled back to Thermal Naphtha cracker unit, ethylene (193), propylene (195) and $C_3/C_4$ stream (196). The stream $C_3/C_4$ (196) is then routed to propane dehydrogenation unit (197) to produce propylene (198) while remaining $C_4$ (199) is recycled back to Thermal Naphtha cracker unit (185) for complete conversion.

EXAMPLES

Two crude blends from an Indian refinery and the properties were analyzed and provided in Table-1.

TABLE 1

Properties of crude blends

| Properties | Crude-1 | Crude-2 |
|---|---|---|
| Density, Kg/m$^3$ | 742.4 | 849.7 |
| CCR, wt % | 5.49 | 0.96 |
| Sulfur, wt % | 1.83 | 0.2 |
| Asphaltenes, wt % | <0.01 | <0.01 |
| ASTM D2887 distillation, deg C. vs wt % | | |
| 5 | 70 | 73 |
| 10 | 105 | 94 |
| 30 | 215 | 208 |
| 50 | 308 | 275 |
| 70 | 420 | 352 |
| 90 | 487 | 465 |
| 95 | 514 | 524 |
| 100 | 542 | 636 |
| Paraffins + Naphthenes, wt % | 65.1 | 72.8 |
| Olefins, wt % | Nd | Nd |
| Aromatics, wt % | 34.9 | 27.2 |
| Ca, ppmw | <1 | 9 |
| Fe, ppmw | 2 | 6 |
| Mg, ppmw | <1 | <2 |
| Na, ppmw | 8 | <2 |
| Ni, ppmw | 24 | <2 |
| V, ppmw | 42 | <2 |
| Ti, ppmw | <1 | <2 |

In a preferred feature of the present invention, crude oils with properties provided in Table-1 were subjected to multiple steps of processing as per the process scheme described above in FIG. 1 employing the constituent process units and the results of the final product yields of interest are provided in Table-2.

TABLE 2

Product yield pattern obtained by crude to chemical conversion

| Product yield, wt % of crude | Crude-1 | Crude-2 |
|---|---|---|
| Ethylene | 5.7 | 6.2 |
| Propylene | 19.0 | 20.7 |
| Butenes | 7.4 | 8.1 |
| BTX | 18.6 | 19.2 |
| MS | 10.5 | 10.0 |
| HSD | 1.4 | 1.3 |
| Sulfur | 1.1 | 0.4 |
| Naphtha | 0.0 | 0.0 |
| Total | 88.4 | 78.9 |
| % Chemical conversion | 50.7 | 54.2 |

Comparison of process as disclosed in the present invention with the process known in the art, particularly, with US2019/0256786A1.

In one feature of the present invention, the Resid is processed in resid slurry hydrocracker, to produces gas oils with low sulfur, nitrogen content and is beneficial for FCC catalyst in terms of increased catalyst life and reduced operating cost as compared to process of US2019/0256786A1 where resid is processed in DCU.

TABLE 3

Comparison of Resid processing with US2019/0256786A1

| Properties | US2019/0256786A1 DCU Gas oils | Present Scheme resid slurry hydrocracker gas oils |
|---|---|---|
| Sulfur, wt % | 4.33 | 3.31 |
| Nitrogen, wt % | 0.24 | 0.15 |

Value extraction from Pitch containing saturates with low sulfur, nitrogen, metals, less production of unwanted product, making the present process more profitable.

TABLE 4

Comparison of Value extraction from Pitch

| Properties | Present Scheme DCU feed quality | US2019/0256786A1 DCU feed quality |
|---|---|---|
| Sulfur, wt % | 3.8 | 4.74 |
| Ni/V, ppmw | 32/97 | 87/149 |
| Nitrogen wt % | 0.4 | 0.52 |

The process scheme of present invention produces higher quality coke meeting anode grade specifications compared to scheme of US2019/0256786A1 where coke is of fuel grade quality.

TABLE 5

Comparison of Coke Quality

| Properties | Present Scheme Coke Quality | US2019/0256786A1 Scheme Coke quality | Anode grade coke specs |
|---|---|---|---|
| Sulfur, wt % | 1.28 | 7.1 | 3.5 |
| Ni/V, ppmw | 170/100 | 182/731 | <200/<350 |
| HGI | <100 | 150 | <100 |
| VCM wt % | 5-9 | 12 | 12 |
| Structure | Sponge | Shot | Sponge |

TABLE 6

Comparison of Coke Quality

| Properties | Present Scheme Coke Quality | US2019/0256786A1 Scheme Coke quality | Anode grade coke specs |
|---|---|---|---|
| Sulfur, wt % | 1.12 | 7.1 | 3.5 |
| Ni/V, ppmw | 170/100 | 182/731 | <200/<350 |
| HGI | <100 | 150 | <100 |
| VCM wt % | 0.1 | 12 | 12 |
| Structure | Sponge | Shot | Sponge |

We claim:

1. A process for converting a crude oil to high value petrochemicals products, the process comprising:

i. charging the crude oil to a Desalter unit to obtain a desalted crude oil;

ii. fractionating the desalted crude oil in a primary fractionation section to obtain straight run fractions, wherein the straight run fractions comprise an upper Light cut having a boiling point below 350° C., a Middle cut having a boiling point in a range of 350-560° C. and a Lower heavy cut having a boiling point above 560° C.;

iii. routing the Lower heavy cut to a first Resid upgradation unit to obtain Fuel gas (FG) and LPG, Naphtha having a boiling point in a range of $C_5$ to 140° C., Light Gasoil (LGO) having a boiling point in a range of 140-370° C., Heavy Gasoil (HGO) having a boiling point in a range of 370-560° C. and unconverted Pitch having a boiling point above 560° C. by Residue Slurry Hydrocracking;

iv. routing the Middle cut from Primary fractionation section HGO from the first Resid upgradation unit and Heavy Coker Gas oil (HCGO) from a second Resid upgradation unit to a Hydrotreater Unit to obtain a combined Hydrotreated Gasoil stream;

v. routing the combined Hydrotreated Gasoil stream to a High severity Fluid Catalytic Cracking Unit (FCCU), to obtain FG, LPG, Naphtha having a boiling point in a range of $C_5$ to 210° C., Light Cycle Oil (LCO) having a boiling point in a range of 210 to 340° C., and Clarified oil (CLO) with a boiling point above 340° C.;

vi. routing the unconverted Pitch from the first Resid upgradation unit and CLO from the FCCU to the second Resid upgradation unit for Delayed Coking reactions to obtain FG, LPG, Coker Naphtha with a boiling point in a range of $C_5$ to 140° C., Light Coker Gas oil (LCGO) having a boiling point in a range of 140 to 370° C., Heavy Coker Gas oil (HCGO) having a boiling point in a range of 370 to 540° C. and Coke;

vii. withdrawing a part of the Coke as high value Coke product and routing the remaining Coke to a Coke Gasifier unit where it is converted to syngas, and syngas is converted to olefins using Syngas to Methanol (STM) and Methanol to Olefins (MTO) processes;

viii. splitting the LCGO stream from the second Resid upgradation unit into two parts on a mass ratio without altering boiling range (140-370° C.) and routing a first part along with the Light Cycle Oil from the high severity FCC unit and Light Cycle Oil having a boiling point in a range of 210 to 340° C. recycled from a Catalytic Naphtha Cracker unit, to a Selective Mild Hydrocracking unit (SMHC) to obtain Fuel Gas, LPG, a Light cut having a boiling point in a range of $C_5$ to 90° C., a Middle cut having a boiling point in a range of 90 to 180° C. and a Bottom cut having a boiling point above 180° C.;

ix. routing the upper Light cut having the boiling point below 350° C. from Primary fractionation section, the Naphtha having the boiling point in the range of $C_5$ to 140° C. from the first and the second Resid upgradation units, the Light cut having the boiling point in the range of $C_5$ to 90° C. from the SMHC unit, the LGO from the first Resid upgradation unit, the Naphtha having the boiling point in the range of $C_5$ to 210° C. from the FCCU and a second part of the LCGO stream from the second Resid upgradation unit to a Catalytic Naphtha cracker unit to obtain FG, LPG and Gasoline having a boiling point in a range of $C_5$ to 210° C., Light Cycle Oil having a boiling point in a range of 210 to 340° C. and Clarified oil (CLO) having a boiling point above 340° C.;

x. routing the FG and LPG from the first Resid upgradation unit, the High severity Fluid Catalytic Cracking Unit (FCCU), the second Resid upgradation unit, the Selective Mild Hydrocracking unit, the Catalytic Naphtha cracker unit, and a Methanol to Olefin conversion unit to Olefin recovery section having a $C_2$ splitter, a Propylene Recovery Unit (PRU) and a $C_4$ splitter, to obtain ethane, ethylene, propylene, butylenes and $C_3/C_4$ paraffins;

xi. routing the $C_3$ paraffins stream to a propane dehydrogenation unit to obtain propylene;

xii. routing the $C_4$ paraffins back to Catalytic Naphtha cracker unit for complete conversion;

xiii. routing the Middle cut having the boiling point in the range of 90 to 180° C. from the Selective mild hydrocracking unit and the gasoline having the boiling point in the range of $C_5$ to 210° C. from the Catalytic naphtha cracker unit to an Aromatic recovery unit to obtain an extract stream containing Benzene, Toluene, Xylene and a raffinate stream containing paraffins;

xiv. routing the raffinate stream containing paraffins to the Catalytic Naphtha cracker unit as a recycle stream.

2. The process as claimed in claim 1, wherein the desalted crude oil is fractionated in an atmospheric distillation unit, a vacuum distillation unit or a combination thereof.

3. The process as claimed in claim 1, wherein the Primary fractionation section comprises an Atmospheric distillation unit operating at a pressure in a range of 1-2 $Kg/cm^2(g)$ and at a top temperature in a range of 150 to 250° C.; and a Vacuum distillation unit operating at a pressure in a range of 0.01 to 0.05 $Kg/cm^2(g)$.

4. The process as claimed in claim 1, wherein the processing of the Light Coker Gas Oil from the second resid upgradation unit, the light cycle oil from the Catalytic Naphtha cracker unit and the Light Cycle Oil from the high severity FCC unit using Selective Mild Hydrocracking increases yield of aromatics and light olefins.

5. The process as claimed in claim 1, wherein the mass ratio at which the LCGO stream from the second resid upgradation unit is split, is in a range of 10:90 to 90:10 for routing to the SMHC and the Catalytic Naphtha Cracker Units.

6. The process as claimed in claim 1, wherein the upper light cut with the boiling point below 350° C. from the primary fractionation section, the Naphtha from the first and second Resid upgradation units, and FCC unit is optionally routed to a Thermal Naphtha cracker unit to generate lighter olefins, pyrolyzed gasoline, and ethylene tar (Pyrolytic Fuel oil) via a Naphtha hydrotreater unit to remove Sulfur and Nitrogen impurities.

7. The process as claimed in claim 1, wherein the upper light cut with the boiling point below 350° C. from the primary fractionation section comprises Straight Run Naphtha, Kerosene, Light Gas Oil, Heavy Gas Oil and the middle cut comprises Vacuum diesel and Vacuum Gas Oil (VGO) and the Lower heavy cut comprises Vacuum Residue (VR).

8. The process as claimed in claim 1, wherein the high value coke is a graphite grade coke with a sponge structure and a sulfur concentration in a range of 1-3 wt %.

9. The process as claimed in claim 1, wherein the first Resid Upgradation Unit is a Residue Hydrocracking Unit, wherein a catalyst in the first Resid Upgradation Unit comprises an oil soluble liquid catalyst, and wherein the oil soluble catalyst comprises 1-5 wt % of Ni and 95-99 wt % of Mo.

10. The process as claimed in claim 6, wherein the Naphtha Hydrotreater Unit is operated at a temperature in a range of 300-360° C. and at a pressure in a range of 10-20 bar.

11. The process as claimed in claim 1, wherein the selective mild hydrocracking unit has two reactors for hydrotreating and for selective mild hydrocracking.

12. The process as claimed in claim 1, wherein the Second Resid upgradation unit is a Delayed Coker Unit having coke drums, wherein the coke drums are operated at a temperature in a range of 470 to 520° C. and at an operating pressure ranging from 0.5 to 5 $Kg/cm^2$ (g) and a residence time in a range of 10 to 32 hours.

13. The process as claimed in claim 1, wherein the High severity FCC unit operates at a temperature of 550 to 650° C., at a pressure in a range of 0.7 to 2.5 $Kg/cm^2$ (g), and a catalyst to oil ratio is in a range of 10 to 25.

14. The process as claimed in claim 1, wherein the Catalytic Naphtha Cracker Unit operates at a reactor outlet temperature of 580 to 670° C., at a reactor pressure in a range of 0.7 to 2.5 $Kg/cm^2$ (g), and a catalyst to oil ratio in the range of 15 to 30.

15. The process as claimed in claim 1, wherein the first Resid upgradation unit is a Residue Slurry Hydrocracker Unit and operates at a pressure in a range of 45 to 80 $Kg/cm^2$ (g), and at a temperature in a range of 360 to 450 C.

16. The process as claimed in claim 1, wherein the coke Gasifier operates with a $1^{st}$ stage as a Low temperature fluidized gasifier and a $2^{nd}$ stage as a high temperature entrained Gasifier, wherein the $1^{st}$ stage has a temperature in a range of 750 to 825° C., a residence time is in a range of 50 to 100 seconds, and wherein the $2^{nd}$ stage has a temperature in a range of 1400 to 1500° C. and a residence time in a range of 2 to 5 seconds.

17. A system for converting a crude oil to high value petrochemicals products, the system comprising:

a. a desalter unit to obtain a desalted crude oil from the crude oil;

b. a primary fractionation section comprising an atmospheric distillation unit and a vacuum distillation unit to receive the desalted crude oil from the desalter unit and to separate the desalted crude oil into an upper cut having a boiling point below 350° C., a middle cut having a boiling point in a range of 350-560° C. and a lower heavy cut having a boiling point above 560° C.;

c. a Slurry hydrocracker unit as a first resid upgradation unit to receive the lower heavy cut and to hydrocrack the lower heavy cut to generate FG, LPG, Naphtha, LGO, HGO and an unconverted Pitch;

d. a Delayed Coker Unit as a second upgradation unit to receive and to upgrade the unconverted Pitch and the FCC Clarified Oil by Delayed Coking to generate FG, LPG, Coker Naphtha, LCGO, HCGO and a solid petroleum coke;

e. a Coke Gasifier Unit to receive the solid petroleum coke produced in the second upgradation unit for converting it to Syngas;

f. a Syngas to Methanol conversion unit to convert the Syngas from the Coke Gasifier Unit to Methanol;

g. a Methanol to olefin unit to convert the methanol to light olefins;

h. a Hydrotreater Unit to receive the Middle cut from the primary fractionation section, HGO from the Slurry hydrocracking unit and the Heavy Coker Gas Oil from the Delayed Coker Unit to generate a combined Hydrotreated gasoil stream;

i. a High Severity Catalytic Cracker Unit to receive a combined Hydrotreated gasoil stream from Hydrotreater Unit to generate a Clarified Oil stream, gaseous products, wherein the gaseous products comprise FG and LPG, Light Cycle Oil and Naphtha;

j. a Selective mild hydrocracking unit (SMHC) comprising hydrotreating and selective mild hydrocracking reactors, to receive the Light Cycle Oils from the High Severity FCC unit and the Catalytic Naphtha Cracker Unit and a part of the Light Coker Gas Oil from the Delayed Coker unit to generate FG and LPG, a Light cut, a Middle cut and a Bottom cut;

k. a Catalytic Naphtha Cracker Unit to receive the upper cut from the primary fractionation section, a Paraffinic Raffinate from the Aromatic recovery unit, a Light cut from the SMHC unit, Naphtha and LGO from the Slurry Hydrocracker Unit, Naphtha from the FCC unit, Naphtha and a part of LCGO from the Delayed Coker Unit and a recycle of C4 paraffins, and to subject them to catalytic cracking to generate lighter olefins and aromatics;

l. a $C_2$ splitter and a Propylene Recovery Unit (PRU) to receive the FG and LPG from the first resid upgradation unit, the second resid upgradation unit, the High Severity FCC Unit, the Catalytic Naphtha cracker Unit, the Methanol to Olefin conversion unit and the selective mild hydrocracking unit to generate ethane, ethylene, propylene, butylenes and $C_3$, $C_4$ paraffinic stream; and m. a propane dehydrogenation unit to receive the $C_3$ paraffin stream and generate propylene; and n. an aromatic recovery unit to receive the Middle cut having a boiling point in a range of 90 to 180° C. from the SMHC unit and the gasoline from the Catalytic naphtha cracker unit to obtain an Extract stream comprising Benzene, Toluene, Xylene and a Raffinate stream comprising paraffins.

18. The system as claimed in claim 17, wherein the system is provided with a Naphtha Hydrotreater unit for receiving fully or a part of the upper cut and naphtha streams for removing Sulfur and Nitrogen and a Steam cracker unit to receive a treated naphtha stream to generate lighter olefins, pyrolyzed gasoline, and ethylene tar (Pyrolytic Fuel oil) by thermal cracking.

* * * * *